United States Patent [19]

Gorgerino et al.

[11] 4,414,027

[45] Nov. 8, 1983

[54] METHOD FOR OBTAINING IRON-BASED ALLOYS ALLOWING IN PARTICULAR THEIR MECHANICAL PROPERTIES TO BE IMPROVED BY THE USE OF LANTHANUM, AND IRON-BASED ALLOYS OBTAINED BY THE SAID METHOD

[75] Inventors: Mario Gorgerino, Meyzieu; Daniel Videau, Le Touvet, both of France

[73] Assignee: Companie Universelle d'Acetylene et d'Electrometallurgie, France

[21] Appl. No.: 257,859

[22] Filed: Apr. 27, 1981

Related U.S. Application Data

[62] Division of Ser. No. 26,778, Apr. 3, 1979, Pat. No. 4,290,805.

[30] Foreign Application Priority Data

Apr. 6, 1978 [FR] France ..... 78 10254

[51] Int. Cl.[3] ..... C22C 33/08

[52] U.S. Cl. ..... 420/578; 75/130 R; 75/130 A; 75/130 AB; 420/580

[58] Field of Search ..... 75/130 R, 130 A, 130 AB, 75/134 S; 420/416

[56] References Cited

U.S. PATENT DOCUMENTS

| | | | |
|---|---|---|---|
| 2,873,188 | 2/1959 | Bieniosek | 75/130 R |
| 3,072,476 | 1/1963 | Knapp | 420/416 |
| 3,137,570 | 6/1964 | Mickelson | 75/130 R |
| 3,177,071 | 4/1965 | Ebert | 75/129 |

FOREIGN PATENT DOCUMENTS

| | | | |
|---|---|---|---|
| 2529230 | 1/1976 | Fed. Rep. of Germany | 420/416 |

*Primary Examiner*—P. D. Rosenberg
*Attorney, Agent, or Firm*—Steinberg & Raskin

[57] ABSTRACT

This invention relates to the use of lanthanum in the production of iron-based alloys. Accordingly, is provided a method comprising adding at least 0.0001 to about 0.5 to 2 weight percent of lanthanum to said iron-based alloy during its production. Thus the solidification curve is modified, as shown in FIG. 2, thereby reducing or preventing certain defects of said alloys, such as pinholes and cavities in spheroidal graphite cast-irons, carbides in flaky graphite grey-iron; the castability, rollability and anisotropy of steels are improved.

2 Claims, 10 Drawing Figures

Figure 2:
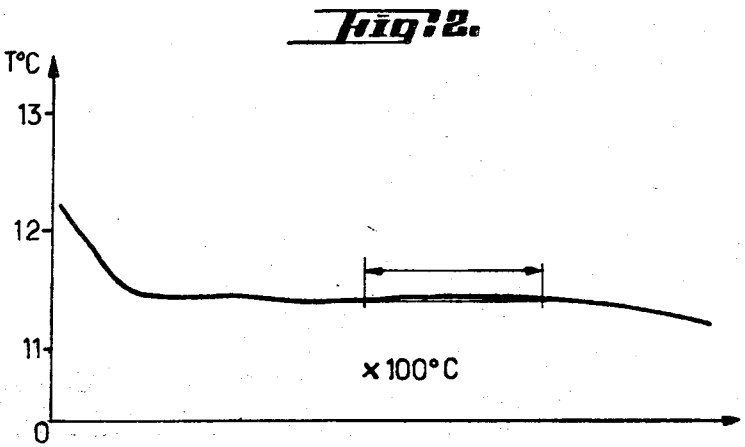

METHOD FOR OBTAINING IRON-BASED ALLOYS ALLOWING IN PARTICULAR THEIR MECHANICAL PROPERTIES TO BE IMPROVED BY THE USE OF LANTHANUM, AND IRON-BASED ALLOYS OBTAINED BY THE SAID METHOD

This is a division of application Ser. No. 26,778 filed Apr. 3, 1979 now U.S. Pat. No. 4,290,805.

The present invention relates generally to the use of lanthanum in the production of iron-based alloys such as flaky graphite cast-iron and/or spheroidal graphite cast-iron, or steels.

More specifically, the present invention relates to a method of obtaining iron-based alloys allowing their mechanical properties to be improved by the use of lanthanum, particularly in the form of inoculating alloys with a low cerium, or more generally, low rare-earth (including cerium) content, i.e. with a lanthanum-to-rare earth (except lanthanum) weight ratio at least higher than 2/1 or preferably higher than 10/1, and for certain particular uses, higher than 100/1. The invention also relates to lanthanum-containing inoculating alloys for carrying out the said method, as well as the iron-based alloys obtained by the method according to the invention.

Furthermore, the method according to the invention allows certain defects of the iron-based alloys, such as pinholes, cavities or shrinkage holes, carbides in the spheroidal graphite cast-irons to be reduced or prevented: the presence of carbides in flaky graphite grey-iron to be prevented; the castability and rollability of steels to be improved and/or their anisotropy to be reduced.

Pinholes and cavities constitute two preponderant defects affecting castings, in particular spheroidal graphite cast-irons. The said cavities are also referred to as "shrinkage holes" and constitute the B 221 type defect in the International Classification of casting defects. The said pinholes are usually located under the skin of the casting and are revealed by shot-blasting of the latter and constitute the B 123 type defect in the International Classification of casting defects.

Anisotropy constitutes a defect of steels which often possess different mechanical properties in the longitudinal direction compared to the transverse direction, particularly in impact strength.

Spheroidal graphite cast-iron is obtained by adding magnesium to a basic cast-iron of the following composition (weight percent):

C=3.3 to 3.8;
Si=1.8 to 3;
Mn=0.10 to 0.50;
P=≦0.05;
S=≦0.020

Magnesium is added either in the form of pure metal, or more frequently, in the form of Fe- Si- Mg alloys. Some of these alloys contain cerium (0.2 to 0.4% of the alloy) which is intended to oppose the possible effect of the Pb, Bi, As elements, all of which are antinodulizing elements. The cast-iron thus treated solidifies according to the two diagrams "Fe-$CFe_3$" and "Fe-graphite".

It should be noted that the addition of magnesium to the cast-iron results in the following:

(a) there is a tendency to solidification according to the metastable diagram Fe-$CFe_3$ which results in the formation of carbide.

(b) This type of solidification involves considerable supercooling phenomena, the importance of which depends upon the type of solidification, part of which takes place according to the diagram "Fe-$CFe_3$" and the other part of which takes place according to the diagram "Fe-graphite". At the present time, the solidification cycle is not controlled by the production process.

(c) An important inoculation usually allows reversion to the Fe-graphite diagram, but the results are irregular, for they depend upon the cooling moduli of the castings (or of their parts).

This method allows the presence of carbides in flaky graphite grey-irons to be obviated. Previous tests performed on flaky graphite grey-irons, or on steel, by means of misch metal (highly variable mixture of 15 rare-earth elements) or of rare-earth silicides have given fragmentary and conflicting results which are unusable in the industrial practice.

The purpose of the present invention is therefore to obviate the aforementioned drawbacks and to provide a solution allowing certain defects in iron-based alloys to be reduced or prevented, such as pinholes, cavities in spheroidal graphite cast-iron, carbides in flaky-graphite or lamellar grey-iron, anisotropy in steels, which is usable in the industrial practice and allows the mechanical properties of the said iron-based alloys to be improved as much as possible.

The solution consists, according to the invention, in a method of obtaining iron-based alloys, characterized in that it comprises the addition of at least 0.0001% by weight to about 0.5 to 2% by weight of lanthanum to the said iron-based alloy during its production or manufacture, i.e. during any stage of treatment involved in the said production. Preferably, this method comprises the addition of about 0.0001% to about 0.01% by weight (i.e. 100 ppm) of lanthanum to the said iron-based alloy during its production.

According to a more preferred characterizing feature, there can be added from about 0.001% by weight (i.e. 10 ppm) to about 0.01% by weight, preferably to about 0.003% (i.e. 30 ppm) by weight to the iron-based alloy during its production.

According to another characterizing feature of the present invention, lanthanum can be added in the form of an alloy or alloys with any metal capable of forming a homogeneous compound with lanthanum, i.e. displaying a solubility diagram with lanthanum alone or associated with other rare-earths in a proportion of 0.01% to 90% by weight; or in the form of compounds such as chlorides, fluorides, oxides obtained from lanthanides or their mixtures, provided the lanthanum/rare-earths (except lanthanum) weight ratio is at least higher than 2/1 or preferably higher than 10/1 and for certain particular uses higher than 100/1.

In this connection, it may be pointed out that the addition of misch metal (with a high proportion of cerium) in steel modifies the nature of the sulfides by rendering them less harmful, but does not improve the purity of the steel which remains loaded with an important amount of inclusions. The invention solves this problem.

It may be pointed out that, in certain cases, use can possibly be made of lanthanum in the form of pure metal lanthanum with a purity preferably higher than 99%. The particularly preferred lanthanum-containing inoculating alloys of the present invention are alloys based on Si-La-Al, La-Ni, La-Fe-Si, La-Fe-Si, La-Fe-Mn, Si-Ca- Mg-La, La-Cr, Si-La-Mn and in which iron may constitute the balance. In case these lanthanum-containing inoculating alloys contain other rare-earths, including cerium, the aforesaid lanthanum/rare-earths (except lanthanum) ratio must in all cases be observed.

According to the method of the present invention, certain defects of cast-iron, such as defects in the form of pinholes and cavities or shrinkage holes are reduced or prevented and the anisotropy of steels is reduced, thus allowing iron-based alloys with improved mechanical properties to be obtained.

In this respect, the applicant has discovered that the aforesaid defects in spheroidal graphite cast-iron such as pinholes and cavities, result from the retention, at various stages, of a gas emitted during solidification. This gas seems to be a reducing gas, for the walls of the cavities are smooth and unoxidized, and it may be assumed that the gas is CO, or hydrogen, or a combination of both.

The occurrence of this reducing gas (at least as far as CO is concerned) does not seem to be casual as alleged to date (oxidized raw material, oxidizing atmosphere, etc..) but systematic at certain stages of the solidification, very likely at the liquidus.

By using the metallurgical and thermodynamic properties of each of the rare-earth elements, the Applicant has found that the said properties are quite specific and sometimes antagonistic. Indeed, the Applicant has found that:

cerium and lanthanum exhibit complete miscibility in liquid iron;

the solubility of cerium in iron at 600° C. is between 0.35 and 0.40%. This element then forms compounds such as $Ce\text{-}Fe_5$ (hard and brittle), $Ce\text{-}Fe_2$ etc;

lanthanum, on the contrary, exhibits low solubility in iron (no definite La-Fe compounds).

It results from the foregoing that the activity of Ce will be low, since it is in the form of intermetallic compounds, whereas lanthanum will exhibit high activity, for it remains available for reactions with oxygen and sulphur.

The use of lanthanum in the form of composite (nodulizing, inoculating, desulphurizing) alloys thus allows a more important purification of the bath in oxygen and sulphur to be obtained, resulting in increased ferritization of the matrix, and permits the mechanical properties of the iron-based alloys obtained to be improved.

It should be noted that the presence of cerium in relatively important amounts, i.e. from about 1%, either alone or in combination with other rare-earths, except lanthanum, with respect to the proportion of lanthanum, as in the case of the misch metal used previously, does not practically ensure the improvements obtained with lanthanum according to the present invention with low cerium content, for the Applicant has discovered that the effect of cerium is harmful and antagonistic to lanthanum and appears as soon as the cerium content is about 1% with respect to the proportion of lanthanum.

Other purposes, characterizing features and advantages of the present invention will appear more clearly as the following explanatory description proceeds with reference to the following examples given solely by way of illustration and which, therefore, can in no way limit the scope of the present invention. Examples 1 to 4 are illustrated by FIGS. 1 to 10 of the drawings. FIGS. 1 to 6 represent the solidification curves of spheroidal graphite cast-iron, in which the temperature is mentioned in ordinates whereas time is mentioned in abscissas. FIGS. 7 to 10 show the cavities or shrinkage holes in castings obtained according to the prior art (FIGS. 7, 9 and 10) and according to the present invention (FIG. 8). In the examples, the contents are given in weight percent.

EXAMPLE 1

Cast-iron of the following composition is manufactured in a basic cupola:

C=3.68;
Si=2.65;
Mn=0.28;
S=0.013

Figure 1:
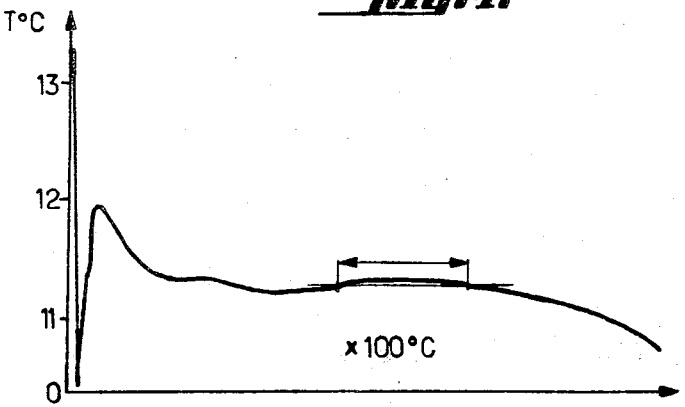

This cast-iron is obtained without inoculation and serves as a reference. The solidification curve obtained in a "MECI" crucible, with a Cr-Ni thermocouple for such a reference cast-iron is represented in FIG. 1. This "MECI" crucible does not alter the solidification of the small ingot and ensures in particular a solidification that is altogether comparable with that of a casting in a sand mould. The eutectic level is locatable by an anomaly in the cooling curve which is characterized by a change in the inflection of the registered curve (see FIG. 1).

When there is added to the said cast-iron, during its production, 0.3% by weight of Si-La-Al alloy (Si=63%; La=2.1%; Al=1.45%, the balance being iron), i.e. 0.0063% by weight of lanthanum, i.e. 63 ppm, castings are obtained that display no cavity. The solidification curve obtained, represented in FIG. 2, shows an extension of the solidification interval of the order of 37% with respect to the curve of FIG. 1, as well as a shifting on the rise by 13° C. of the temperature of the transformation level. This displacement of the position of the eutectic level involves a passage to the Fe-graphite diagram and an extension of the solidification interval permits an effective degasing, leading to the formation of the afore-mentioned sound casting.

EXAMPLE 2

Use is made of a basic cast-iron of the following composition:

C=3.40;
Si=2.70;
Mn=0.12;
S=0.010 which is manufactured in an electric furnace. During the manufacture, an inoculation is performed with 0.4% of inoculating alloy usually employed in foundry, of the following composition:

Si=70;
Ca=0.7;
Al=4;
Fe=the balance.

Figure 3:
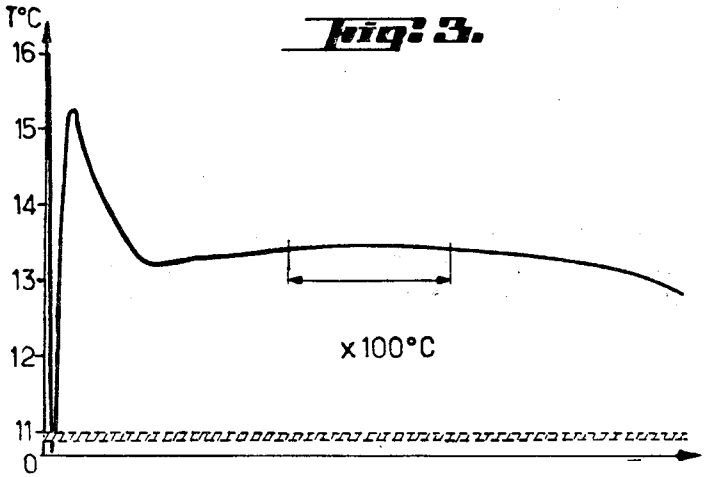
Figure 5:
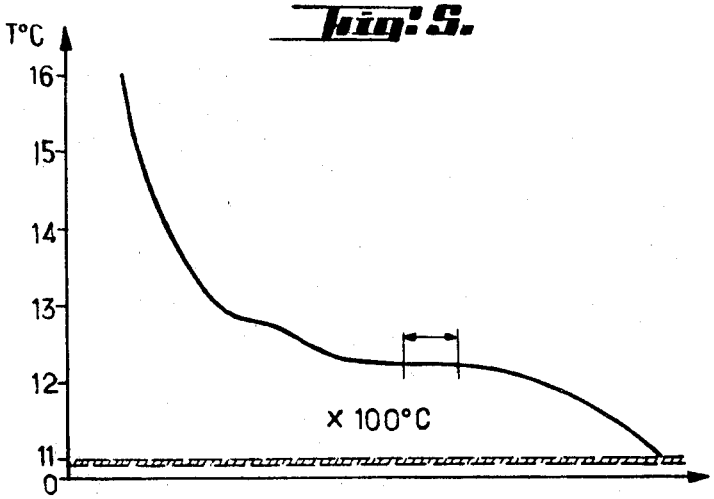
Figure 6:
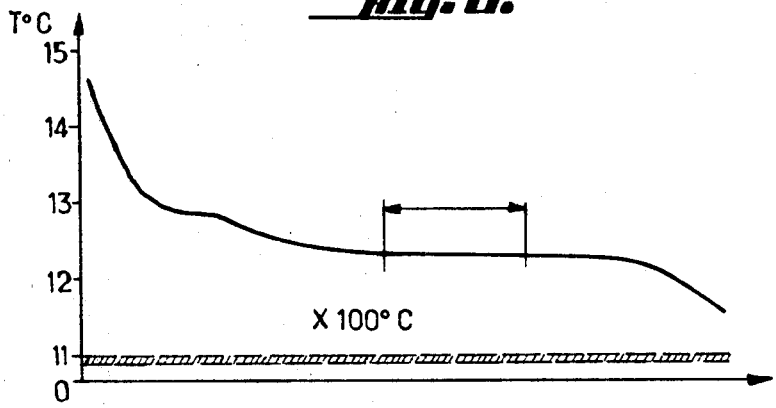

The solidification curve obtained by using a "MECI" crucible is represented in FIG. 3. The castings obtained display appearance defects such as cavities.

When there is added, according to the present invention, during the production of this cast-iron, 0.4% of an alloy of the following composition:

Si=63%;
La=2.1;
Al=1.45%;
Fe=the balance, i.e. 0.0084% of lanthanum, i.e. 84 ppm.

Figure 4:
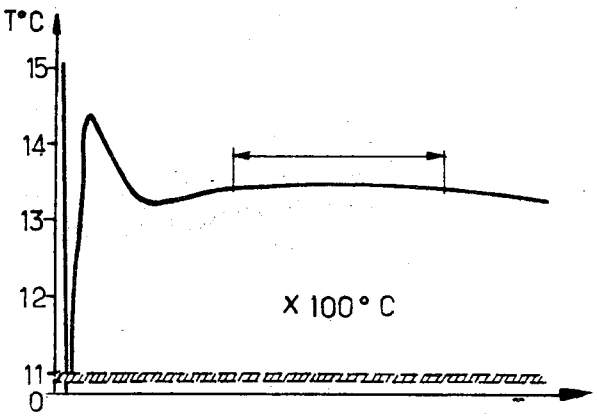

The solidification curve represented in FIG. 4 is obtained, showing an extension of the solidification interval of the order of 30% and an increase in the temperature of the transformation level of the order of 10° C. The castings obtained are free from cavities.

EXAMPLE 3

Use is made of cast-iron of the following basic composition:

C=3.43%;
Si=2.62%;
Mn=0.18%;
S=0.011%, which is produced in an electric furnace.

To this cast-iron is added, during its manufacture, 0.4% of inoculating alloy usually employed in foundry, mentioned in Example 2. There is obtained the cooling curve represented in FIG. 5, which has been registered on special "tellurium-S" electronite crucibles. These crucibles are provided with a carbide-generating coating and ensure a cooling in only the metastable diagram "Fe-$CFe_3$". Although being less representative of the practical solidification of the castings, this type of crucibles allow a well-marked eutectic level to be obtained, permitting easier comparison between the various lengths of the eutectic levels.

According to the method of the present invention, an addition is made, during the production of this cast-iron, of 0.4% of lanthanum-containing alloy substantially free from cerium, mentioned in Example 2. There is obtained the cooling curve represented in FIG. 6, which shows an increase in length of the transformation level of the order of 260% and an increase in transformation temperature of about 10° C. with respect to that of FIG. 5.

The castings obtained with the alloy of the present invention are practically sound, the feeder heads display only a small dendritic shrinkage, whereas the castings obtained by the method according to the prior art exhibit cavities and pinholes.

In order to compare the improvement in mechanical properties obtained by the method according to the present invention, tensile test pieces have been prepared and tested. The results obtained are mentioned in Table I below:

TABLE I

| | Tensile strength (da N/sq. mm) | Elongation (%) | Hardness ($H_B$) | Impact strength (da J/sq. mm) |
|---|---|---|---|---|
| Test piece 3 (prior alloy) | 56.4 | 8.2 | 237 | 1.2 |
| Test piece 3b (alloy according to the invention La free from Ce) | 54.2 | 13.9 | 198 | 2.2 |

The important gains in elongation and impact strength obtained confirm the influence of the ferritic structure on the mechanical properties.

EXAMPLE 4

From a basic cast-iron such as C=3.65; Si=2.65; Mn=0.08; S=0.010, prepared to be used in a special method for nodulizing cast-iron in moulds (in-mould process), use has been made of the two following alloys in order to determine the action of lanthanum on the formation of cavities ("shrinkage holes") in the iron cast by this method. The two alloys were obtained from a Fe-Si-Mg master alloy.

| Alloy 1 (of the prior art) | Alloy 2 (of the invention) |
|---|---|
| Si = 48.2% | Si = 48.4% |
| Ca = 0.58% | Ca = 0.57% |
| Mg = 5.8% | Mg = 5.65% |
| Ce = 0.5% (misch metal = 1%) | La = 0.45% |
| Fe = the balance | Fe = the balance |

The misch metal used had the following composition:

Ce=49%;
La=20%;
Balance=other rare earths.

Figure 7:
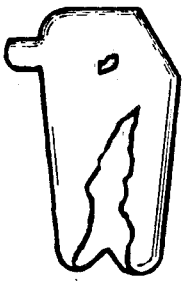
Figure 8:
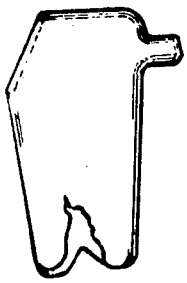

The castings obtained by adding 1% of the alloys 1 and 2 are shown in section in FIGS. 7 and 8, respectively. From FIGS. 7 and 8 it is seen that the alloy 2 according to the present invention allows feeder heads to be obtained which exhibit only primary dendritic shrinkage, whereas the feeder head prepared with the prior misch metal displays a large cavity or shrinkage hole. It should be noted that the lanthanum/rare earths ratio in the misch metal is equal to 0.25. This ratio according to the invention must, as mentioned previously, be equal to at least 2, preferably at least equal to 10, and still more preferably, at least equal to 100.

Mechanical tests have been effected on test blocks obtained after adding the alloy 1 or the alloy 2 and are summed up in Table II below:

TABLE II

| | Tensile strength (da N/sq. mm) | Elastic limit (da N/sq. mm) | Elongation (%) |
|---|---|---|---|
| Test piece Alloy 1 | 41.4 | 31.5 | 17.2 |
| Test piece Alloy 2 (Invention) | 43.6 | 32.1 | 22.5 |

The results obtained confirm the favourable influence of lanthanum on the structure (ferritizing) and the compactness or density of the castings.

In order to confirm the specific action of lanthanum and to determine the antagonistic action of cerium, two complementary tests have been effected, in which 1% of the following alloys, respectively, has been added to the cast-iron:

Alloy 3: Si=48.2%; Ca=0.58%; Mg=5.8%; Ce=1% (misch metal 2%); Fe=the balance.

The misch metal used had the composition previously indicated for alloy 1.

Alloy 4: identical with alloy 3, except that use is made of 0.50% of cerium introduced in the form of Fe—Ce instead of misch metal.

Figure 9:
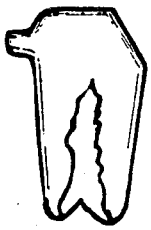
Figure 10:
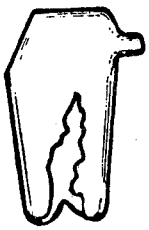

The castings obtained with the addition of alloys 3 and 4 are shown in FIGS. 9 and 10, respectively. It can be seen that there is no reduction of the importance of the cavities even in the case of alloy 3, in which the final La content is 0.4%, which indicates that the presence of cerium in greater amounts than 1% by weight with respect to lanthanum inhibits the favourable effect of lanthanum.

EXAMPLE 5

In producing hypereutectic cast-iron at about 1,310° C., there is inoculated in a manner known per se into the latter 0.5% by weight of inoculating alloy usually employed in foundry, having the following composition (A):

Si=75;

Ca=3;
Al=4;
Fe=the balance.

There is obtained a cast-iron of the composition mentioned in Table III with the physical characteristics also mentioned in Table III.

By inoculating 0.5% by weight of an inoculating alloy according to the present invention, having the following composition (B):

Si=75;
Ca=3;
Al=4;
La=0.5 i.e. 2,510$^{-4}$% by weight of lanthanum, or 25 ppm, there is obtained a cast-iron having the composition and physical characteristics mentioned in Table III. It can be seen that, quite unexpectedly, the number of graphite spheroids obtained is much greater and the hardening effects (carburized region) much less when using the inoculating alloy according to the present invention compared with the known inoculating alloy.

TABLE iii

| Inoculating alloy | Composition of cast-iron obtained | PHYSICAL PROPERTIES | | | | | |
|---|---|---|---|---|---|---|---|
| | | G | $N_{nA}$ | $N_{nL}$ | $Q_g$ | P + C | $C_1$ |
| A (Prior art) | C = 3.92<br>Si = 2.31<br>Mn = 0<br>P = 0.025<br>S = 0.007<br>Ni = 0.73<br>Cr = 0.04<br>Mg = 0.038 | 0.10297 | 491.02 | 7.156 | 0.859 | 0.5598 | 0.0425 |
| B (Invention) | C = 3.91<br>Si = 2.26<br>Mn = 0<br>P = 0.026<br>S = 0.008<br>Ni = 0.70<br>Cr = 0.05<br>Mg = 0.039 | 0.10734 | 568.75 | 8.4375 | 0.989 | 0.4677 | 0.0175 |

Note:
C = Volume parts of graphite
$N_{nA}$ = number of nodules/sq. mm
$N_{nL}$ = number of nodules/mm
$Q_g$ = Quality number (distribution of nodules ideal distribution = 1)
P + C = Pearlite and cementite
$C_1$ = Carbide, volume parts.

In the case of steels, lanthanum can resolve the problems involved in the deoxidation of steel. In this respect, in order to use in the best possible way the desulphurizing properties of lanthanum, it is important to previously deoxidize the steel in a conventional manner, e.g. by previous deoxidation in a furnace by adding 0.8 to 1% by weight of aluminium, which is completed by a deoxidation in the ladle by using lanthanum proportions in the previously mentioned ranges, i.e. in amounts comprised advantageously between 10$^{-4}$% and 10$^{-2}$%, i.e. from 1 to 100 ppm, and preferably from 1-10 to 30 ppm.

Thus, due to the small amount of added lanthanum, there are very little inclusions, the latter being well distributed, thus eliminating the viscosities of the inclusions, resulting in a highly-fluid steel bath, upon solidification, and finally in steel of high purity. Moreover, the almost complete desulphurizing of the steel also reduces the surface tension of the latter and results in improved castability.

These observations are confirmed by the following example:

EXAMPLE 6

It is desired to obtain steel of the following chemical composition:

C=0.19-0.24
Mn=0.65-0.90
Si=0.40-0.60
P=≦0.025
S=≦0.012
Cr=≦0.30
Al=0.025-0.040

To this end, 13,570 kg of steel of a conventional composition are introduced into a furnace and 0.07% of carbon and 0.15% of Mn are added thereto.

In order to perform a refining of the oxygen content, a previous deoxidation is effected in the furnace according to the conventional method, by adding about 0.8% of aluminium. After adding the aluminium, a steel sample withdrawn directly from the furnace has the following composition:

| | |
|---|---|
| C = 0.20 | Cu = 0.06 |
| Si = 0.30 | Cr = 0.12 |
| Mn = 0.46 | Ni = 0.07 |
| P = 0.007 | Sn = 0.007 |
| S = 0.012 | Mo = 0.03 |
| Al = 0.026 | $O_2$ = 0.011 |

The crystallographic analysis shows that this steel has aluminate and silicate micro-inclusions and micro-sulphides.

According to the present invention, after the aforesaid dioxidation in the furnace by means of aluminium, a dioxidation in the ladle is performed by adding 27 kg of a silico-lanthanum alloy comprising 45% Si, 0.5% La, the balance being iron, or an addition of about 0.20% of the lanthanum alloy, which corresponds to an addition of about 10$^{-3}$% of lanthanum, i.e. about 10 ppm.

A steel sample is withdrawn from the ladle after dioxidizing with the inoculating alloy with lanthanum according to the present invention and a steel is obtained with the following composition:

| | |
|---|---|
| C = 0.23 | Cu = 0.06 |
| Si = 0.51 | Cr = 0.13 |
| Mn = 0.85 | Ni = 0.07 |
| P = 0.007 | Sn = 0.007 |
| S = 0.009 | Mo = 0.03 |
| Al = 0.031 | $O_2$ = 0.006 |

The crystallographic analysis of this steel shows that there is obtained a steel comprising aluminate and silicate micro-inclusions by obtaining refractory globules of small mean diameter of the order of 1 to 2 microns and in limited number.

Furthermore, the lanthanum according to the present invention in an alloy with other metals, including rare earths provided the aforementioned lanthanum/rare earths ratio is observed, offers the possibility, in the course of the deoxidation, desulphurizing, denitriding and dehydration kinetics, of providing for and obtaining the number of inclusions of the size and composition desired for the applications of the steel which it is desired to produce, and this is a particularly remarkable industrial result.

Thus, the addition of lanthanum, under the conditions of the present invention, allows the anisotropy of steels to be reduced and thus the longitudinal impact strength to transverse impact strength ratio to be improved.

It should be noted generally that lanthanum is present in the iron-based alloy in the form of compounds such as oxides and/or sulphides and/or nitrides and/or hydrides and/or carbides forming in the iron-based alloys inclusions which cause no inconvenience.

Furthermore, during the manufacture of the iron-based alloy, if the cast iron or the steel settles well, 70% of the lanthanum compounds formed must rise into the slag. Thus, less than 30% of lanthanum compounds is usually found in the iron-based alloy obtained.

Advantageously, the lanthanum is added to the iron-based alloy, during its production in the form of an inoculating alloy having the following composition (weight percent):

| | | |
|---|---|---|
| Si = 60-90 | or | Si = 45-70 |
| Ca = 0.001-4 | | Ca = 0.01-4 |
| Al = 0.1-4 | | Mg = 3-30 |
| La = 0.01-5 | | La = 0.01-5 |
| Fe = the balance | | Fe = the balance |

The steels obtained by the method according to the present invention may be, in particular, structural steels, special steels, stainless steels, casting or rolling steels, but are not limited to such steels.

Of course, the invention is by no means limited to the forms of embodiment described and illustrated which have been given by way of example only. In particular, it comprises all means constituting technical equivalence to the means described as well as their combinations, should the latter be carried out according to its gist and used within the scope of the following claims.

What is claimed is:

1. Alloy for the addition to iron-based alloys to provide such alloys which are substantially devoid of pinholes and cavities in spheroidal graphite cast-irons, and of carbides in flaky grey-iron and having improved castability, rollability, anisotropy and mechanical properties, said alloy having the following composition in percent by weight:

Si=60-90
Ca=0.01-4
Al=0.1-4
La=0.01-5
Fe=the balance.

2. Alloy for the addition to iron-based alloys to provide in spheroidal graphite cast-irons, and of carbides in flaky grey-iron and having improved castability, rollability, anisotropy and mechanical properties, said alloy having the following composition in percent by weight:

Si=45-70
Ca=0.01-4
Mg=3-30
La=0.01-5
Fe=the balance.

* * * * *